US005111733A

United States Patent [19]

Baraniak

[11] Patent Number: 5,111,733

[45] Date of Patent: May 12, 1992

[54] MULTIPLE STAGE HYDRAULIC JACK FOR USE WITH TELESCOPIC JIB

[75] Inventor: Robert Baraniak, Saint Vallier, France

[73] Assignee: PPM, Montceau Les Mines, France

[21] Appl. No.: 665,382

[22] Filed: Mar. 5, 1991

[30] Foreign Application Priority Data

Mar. 6, 1990 [FR] France ..... 90 02810

[51] Int. Cl.[5] ..... F15B 11/18

[52] U.S. Cl. ..... 91/167 R; 91/173; 91/530; 91/535; 92/66

[58] Field of Search ..... 91/167 R, 170 R, 173, 91/525, 535; 92/66, 75, 107, 108, 110

[56] References Cited

U.S. PATENT DOCUMENTS

| | | | |
|---|---|---|---|
| 3,603,207 | 9/1971 | Parrett | 91/167 |
| 3,610,100 | 10/1971 | Hoffman | 91/167 R |
| 3,904,416 | 9/1975 | Onoda et al. | 91/167 R X |
| 3,949,650 | 4/1976 | Blatt et al. | 92/108 |
| 4,741,246 | 5/1988 | Padarev | 91/167 R |

FOREIGN PATENT DOCUMENTS

| | | | |
|---|---|---|---|
| 0296047A1 | 12/1988 | European Pat. Off. . | |
| 1208573 | 1/1966 | Fed. Rep. of Germany . | |
| 3324270A1 | 1/1985 | Fed. Rep. of Germany . | |
| 1424583 | 12/1965 | France . | |
| 0043206 | 3/1984 | Japan | 91/167 R |

*Primary Examiner*—Edward K. Look
*Assistant Examiner*—John Ryznic
*Attorney, Agent, or Firm*—Skjerven, Morrill, MacPherson, Franklin & Friel

[57] ABSTRACT

This invention relates to a multiple jack incorporating at least three elements, viz. two pistons and two cylinders which define large and small chambers of a first cylinder, and large and small chambers of a second cylinder.

According to the invention: a) a first inner conduit connects the large chamber of the first cylinder to a first outer conduit; b) a second inner conduit connects the small chamber of the first cylinder to a second outer conduit; c) a third inner conduit connects the large chamber of the second cylinder to a third outer conduit; and d) a fourth inner conduit connects the small chamber of the second cylinder to a fourth outer conduit.

One application is the production of a telescopic jib presenting a satisfactory flexibility of use.

16 Claims, 5 Drawing Sheets

MULTIPLE STAGE HYDRAULIC JACK FOR USE WITH TELESCOPIC JIB

FIELD OF THE INVENTION

The present invention relates to a multiple jack, to a circuit for supplying such a jack and to a telescopic jib applying said jack.

BACKGROUND OF THE INVENTION

The invention is a result of the research made in the field of telescopic jibs provided with a jack for controlling the telescoping thereof. It is already known to use a double jack, comprising two pistons imbricated one in the other, and two piston rods each integral with one of the two pistons, and to couple the two rods and the cylinder to three successive portions of the jib.

The known double jacks present one or more internal connections, each between two of the working chambers that they comprise, which allow combined extensions of the various elements of the jack, which, of course, also allows combined extensions (and retractions) of the various portions of the telescopic jib, with respect to one another.

U.S. Pat. No. 2,616,489 discloses such a jack.

These known arrangements are most often satisfactory for a determined use of the telescopic jib, but do not allow modes of operation other than the one resulting from the above-mentioned internal connections which have been provided.

The rigid nature of the unique mode of operation provided initially is being considered more and more as a drawback by the users, and it is an object of the invention to overcome this drawback

SUMMARY OF THE INVENTION

The invention therefore generally relates firstly to a multiple jack incorporating at least three elements mounted to slide with respect to one another, comprising: a first cylinder; a first piston, which is mounted to slide inside the first cylinder and which defines therein a first large chamber, of large useful cross section, and a first small chamber, of small useful cross section; a first piston rod, which is fast with the first piston, which traverses a bottom of the first cylinder defining said small chamber of the first cylinder and which comprises a first cylindrical central recess; a second cylinder, which is constituted by said first recess of the first piston rod; a second piston, which is mounted to slide inside the second cylinder and which defines therein a second large chamber, of large useful cross section, and a second small chamber, of small useful cross section; a second piston rod which is fast with the second piston and which traverses a bottom of the second cylinder defining the second small chamber. In this jack: a) a first inner conduit connects the first large chamber to a first conduit outside the jack; b) a second inner conduit connects the first small chamber to a second conduit outside the jack; c) a third inner conduit connects the second large chamber to a third conduit outside the jack; d) a fourth inner conduit connects the second small chamber to a fourth conduit outside the jack; and e) the first large and first small chambers and the second large and second small chambers are not connected by any link inside the jack.

The invention also relates to a circuit for supplying such a jack, comprising, in addition to a jack of this type: a pump provided with its delivery conduit; a discharge reservoir, a first fluid slide valve to which are connected said delivery conduit, a discharge conduit connected to the reservoir, and the first and second outer conduits, and which comprises at least first and second positions, the first position corresponding to the communications of the delivery conduit and of the first outer conduit and of the second outer conduit and the discharge conduit, and the second position corresponds to the obturation of at least one of the first and second outer conduits; and a second fluid slide valve to which are connected said delivery conduit, a discharge conduit connected to the reservoir, and the third and fourth outer conduits, and which comprises at least first and second positions, the first position corresponding to the communications of the delivery conduit and of the third outer conduit and of the fourth outer conduit and the discharge conduit and the second position corresponds to the obturation of at least one of the third and fourth outer conduits.

Finally, the invention relates to a telescopic jib having at least first, second and third portions mounted for relative slide one with respect to the following and applying a jack or a circuit as defined hereinbefore, in which jib: f) the bottom of the first cylinder, which defines the first small chamber, is fixed on one end of the first portion of the telescopic jib; g) the end of the first piston rod which is opposite the first piston, is fixed on one end of the second portion of the telescopic jib; and h) the end of the second piston rod, which is opposite the second piston, is fixed on one end of the third portion of the telescopic jib.

The advantages of the invention reside principally in the obtaining of a considerable flexibility of use, as the relative displacements of the various elements of the jack proposed may be controlled independently of one another, or, on the contrary, be combined together, as chosen by the user.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
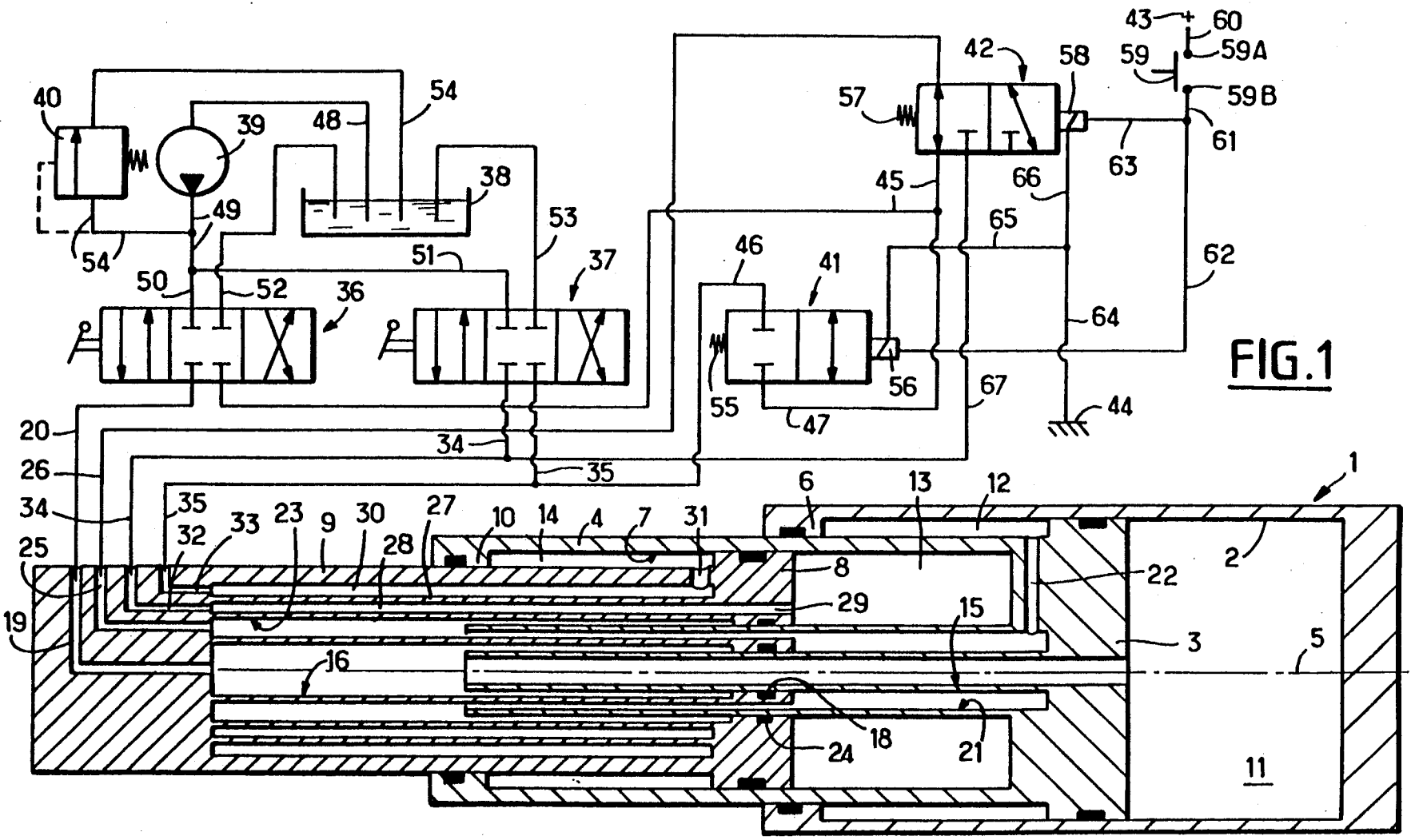
FIG. 1 shows in axial section a jack according to the invention and the diagram of a first variant embodiment of a pressurized fluid supply circuit, likewise according to the invention.

Referring now to the drawings, the assembly of FIG. 1 comprises a hydraulic jack 1 and its pressurized fluid supply circuit.

Jack 1 is constituted by:

a first cylinder 2 comprising an axis of symmetry 5;

a first piston 3 mounted to slide inside the first cylinder, parallel to the direction of axis 5;

a first piston rod 4, which is fast with the first piston 3, which traverses a bottom 6 of the first cylinder and which comprises a first recess 7 forming the inner face of a second cylinder and having axis 5 as axis of symmetry;

a second piston 8 mounted to slide inside the second cylinder 7, parallel to the direction of axis 5;

a second piston rod 9, which passes through the bottom 10 of the second cylinder 7 opposite the first piston 3;

a first large chamber 11 of the first cylinder 2, of large useful cross section, defined by the first cylinder and by that side of the first piston 3 opposite the first piston rod 4;

a first small chamber 12 of the first cylinder 2, of small useful cross section, defined by the first cylinder and by that side of the first piston with which the first piston rod 4 is fast;

a second large chamber 13 of the second cylinder 7, of large useful cross section, defined by the second cylinder and by that side of the second piston 8 opposite the second piston rod 9;

a second small chamber 14 of the second cylinder 7, of small useful cross section, defined by the second cylinder and by that side of the second piston with which the second piston rod 9 is fast;

a first channel 15, constituted by a conduit fast with that face of the first piston 3 with which the first piston rod 4 is fast, and by its extension which traverses the first piston 3 and which opens out in the first large chamber 11, said first channel 15 being contained inside the first recess 7 and coaxial to axis 5;

a second recess 16, which is constituted by a conduit fast with that end 17 of the second piston rod 9 opposite the second piston 8, which conduit is made in this second piston rod 9, which is coaxial to axis 5 and which is capable of surrounding and of containing that part of the first channel 15 extending from the first piston 3, an O-ring 18 being disposed between the end of this second recess 16 and said part of the first channel 15;

a second channel 19, which is made in the end 17 of the second piston rod 9 and which connects the second recess 16 to a first conduit 20 outside the jack 1, having one of its portions coaxial to axis 5;

a third channel 21, which is constituted by a conduit fast with that face of the first piston 3 with which the first piston rod 4 is fast, which is contained inside the first recess 7, which is coaxial to axis 5, which surrounds the conduit constituting the second recess 16 and which is connected to the first small chamber 12 by a connecting channel 22 made in the first piston rod 4;

a third recess 23, which is constituted by a conduit fast with the end 17 of the second piston rod 9, which conduit is made in this second piston rod 9, which is coaxial to axis 5 and which is capable of surrounding and containing said third channel 21, an O-ring 24 being disposed between the end of this third recess 23 and the third channel 21;

a fourth channel 25, which is made in the end 17 of the second piston rod 9 and which connects the annular space included between the wall of the second recess 16 and that of the third recess 23, to a second conduit 26 outside the jack 1, one of the portions constituting the fourth channel 25 being parallel, but eccentric with respect to axis 5;

a cylindrical wall 27, which extends between the second piston 8 and the end 17 of the second piston rod 9, on the one hand, surrounding the wall constituting the third recess 23 and making between this wall (23) and itself (27), a fifth channel 28, annular, which opens out, via another connecting conduit 29 traversing the second piston 8, into the second large chamber 13, on the other hand, being contained inside the outer wall defining the second piston rod 9 and making between this outer wall (9) and itself (27), a sixth channel 30, annular, which, via a connecting conduit 31, made in the second piston rod 9, opens out in the second small chamber 14;

a seventh channel 32 and an eighth channel 33, made in the end 17 of the second piston rod 9, connect the fifth channel 28 and the sixth channel 30 to third (34) and fourth (35) outer conduits, respectively.

Figure 6:
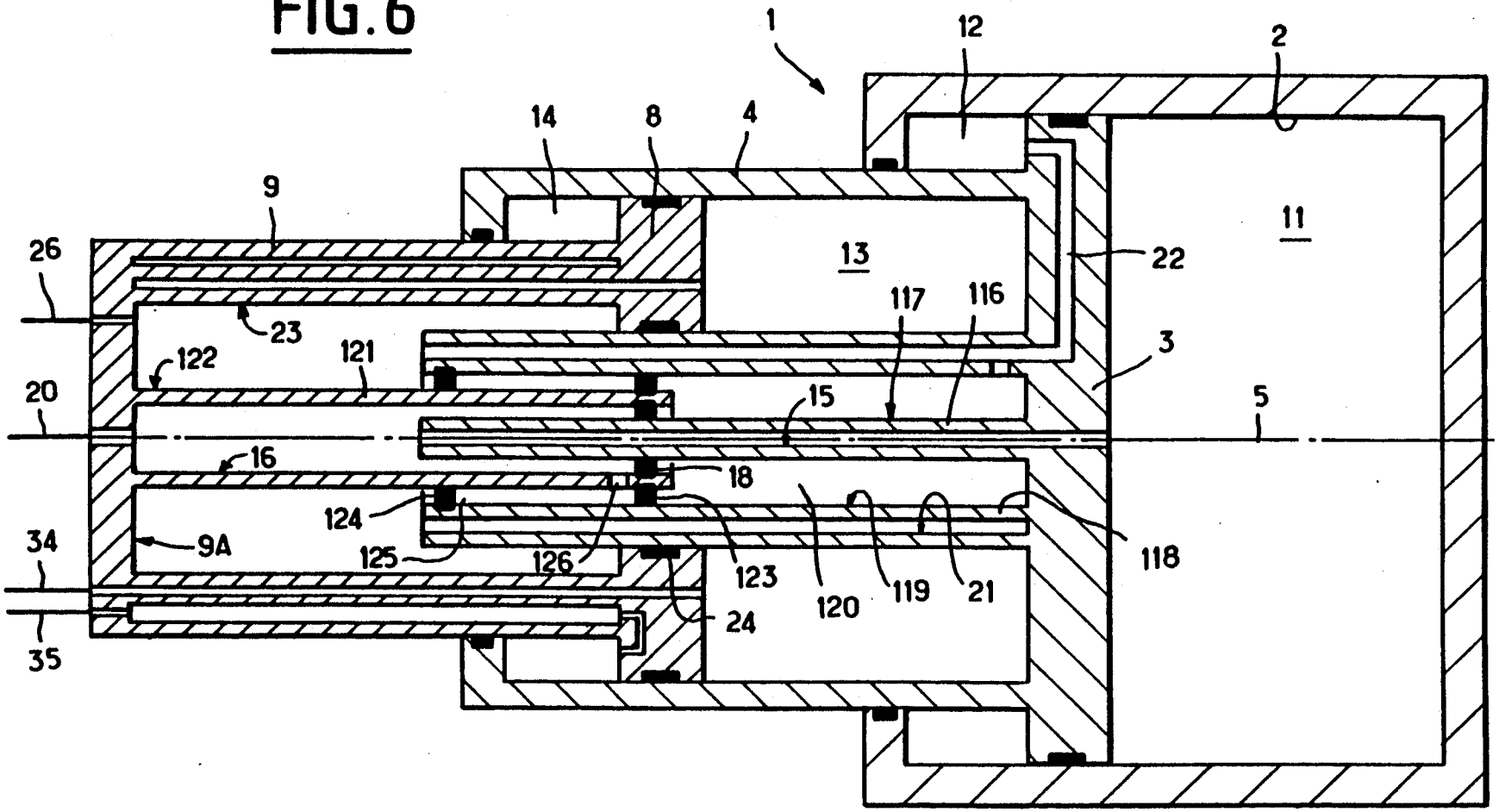
FIG. 6 is an axial section through a variant jack according to the invention.

The variant defined hereinafter with reference to FIG. 6 relates to a jack likewise according to the invention. In this jack, the first channel 15 is constituted by the central recess of a first tubular conduit 116 of which one end is fast with the first piston 3 and the outer face 117 is cylindrical, of section S 117. A second tubular conduit 118, coaxial to axis 5 and to the first tubular conduit 116, also has one of its ends fast with the first piston 3, has its inner face 119 distant from the outer face 117 of the first tubular conduit 116, with the result that a space 120 is made between these two faces 117 and 119. These two tubular conduits 116 and 118 extend parallel to the first piston rod 4, approximately of lengths equal to that of this first piston rod 4. The second recess 16 is itself constituted by the cylindrical bore of a third tubular conduit 121, of which the outer face 122 is also cylindrical, the second recess 16 and the outer face 122 being coaxial, of axis 5. This third tubular conduit 121 has one of its ends fast with the inner face 9A of the bottom of the inner recess that the second piston rod 9 comprises, extends parallel to axis 5 over a length substantially equal to that of said second piston rod 9 between said first tubular conduit 116 and second tubular conduit 118. Two O-rings 123, 124 are disposed between the outer face 122 of the third tubular conduit 121 and the inner face 119 of the second tubular conduit 118 and are located, O-ring 123 in the vicinity of the free end of the third tubular conduit 121 and O-ring 124, in the vicinity of the free end of the second conduit 118. The space included between the outer face 122 of the third tubular conduit 121, the inner face 119 of the second tubular conduit 118 and the O-rings 123 and 124 constitutes a chamber 125, that an orifice 126, which traverses the wall of the third tubular conduit 121, adjacent the O-ring 123, places in communication with the second recess 16. The chamber 125 has a section S 125. It is particularly advantageous if sections S 117 and S 125 are equal:

S 117=S 125

In fact, in such a configuration, a relative displacement of the second piston 8 with respect to the first piston 3 provokes the displacement of a volume of hydraulic fluid due to the displacement of the first tubular conduit 116 inside the third tubular conduit 121, which is exactly equal to the variation in volume of chamber 125, with the result that the first large chamber 11 receives no volume of hydraulic fluid provoked by said initial displacement of the first (3) and second (8) pistons, and no undesirable parasitic displacement of the first piston rod 4 with respect to the first cylinder 2 is created.

The circuit for supplying pressurized fluid to jack 1, shown in FIG. 1, comprises:

a first fluid slide valve 36 with three positions;
a second fluid slide valve 37, likewise with three positions;
a reservoir 38 of fluid not under pressure; a pump 39;
a discharge valve 40 for protection against overpressures;
two slide valves 41 and 42, each with two positions;
a spring 55 and a control electro-magnet 56, with antagonistic effects, are coupled to the two-way slide valve 41;
a spring 57 and a control electro-magnet 58, with antagonistic effects, are coupled to the two-way slide valve 42;
an electric switch 59;
a source of electrical energy supply 43;
an electrical ground 44; and
the following links:
the first outer conduit 20 is connected to the first three-way slide valve 36;
the second outer conduit, of which a first portion 26 connects the fourth channel 25 of the jack to the two-way slide valve 42 and of which a second portion 45 connects said two-way slide valve 42 to the first three-way slide valve 36;
the third outer conduit 34 is connected to the second three-way slide valve 37;
the fourth outer conduit 35 is connected to the second three-way slide valve 37;
the first (46) and second (47) portions of a fifth outer conduit connect, the first portion 46, the fourth outer conduit 35 to the two-way slide valve 41, and, the second portion 47, the two-way slide valve 41 to the second portion 45 of the second outer conduit;
the suction conduit 48 of the pump 39 connects the latter to the reservoir 38;
the delivery conduit 49 of the pump 39 is connected to conduits 50 and 51, themselves connected to the first (36) and second (37) three-way slide valves, respectively;
a discharge conduit 52 connects the first three-way slide valve 36 to the reservoir 38;
another discharge conduit 53 connects the second three-way slide valve 37 to the reservoir 38;
a conduit 54 connects the delivery conduit 49 to the reservoir 38, the discharge valve 40 being disposed in this conduit 54;
a sixth outer conduit 67 connects the third outer conduit 34 to the two-way slide valve 42;
an electrical link 60 connects the electrical source 43 to one of the terminals 59A of the switch 59;
an electrical link 61 connects the other terminal 59B of switch 59 to two other electrical links 62 and 63, themselves connected to the electro-magnets 56, 58 respectively;
an electrical link 64 connects the electrical ground 44 to two other electrical links 65, 66, themselves connected to the electro-magnets 56, 58 respectively.

The three positions of the first three-way slide valve 36 correspond as follows:

the first position, to the communications of the first outer conduit 20 and the conduit 50, and of the second portion 45 of the second outer conduit and the discharge conduit 52;
the second position, to the obturations of conduits 20, 45, 50 and 52; and
the third position, to the communications of the first outer conduit 20 and the discharge conduit 52 and of said second portion 45 of the second outer conduit and conduit 50.

The three positions of the second three-way valve 37 correspond as follows:

the first position, to the communications of the third outer conduit 34 and conduit 51 and of the fourth outer conduit 35 and the discharge conduit 53;
the second position, to the obturations of conduits 34, 35, 51 and 53; and
the third position, to the communications of the third outer conduit 34 and the discharge conduit 53 and of the fourth outer conduit 35 and conduit 51.

The first positions of the two-way slide valves 41, 42 both correspond to the position of the switch 59 in which the terminals 59A and 59B are not connected, and to the predominance of the effects of the springs 55 and 57, whilst there correspond to the connection of terminals 59A and 59B via the switch 59, the second positions of said two-way slide valves 41 and 42, and the predominance of the effects of the electro-magnets 56, 58.

Said positions of the two two-way slide valves 41, 42 correspond as follows:

the first positions, to the obturations of the first (46) and second (47) portions of the fifth outer conduit by the slide valve 41, to the communication of the first (26) and second (45) portions of the second outer conduit, and to the obturation of conduit 67; and
the second positions to the communication of the first (46) and second (47) portions of the fifth outer conduit, of the first portion 26 of the second outer conduit and of conduit 67, and to the obturation, by the slide valve 42, of the second portion 47 of the fifth outer conduit.

In a variant embodiment, the assembly of the two two-way slide valves 41, 42 may be constituted by a single, likewise two-way slide valve.

Figure 2:
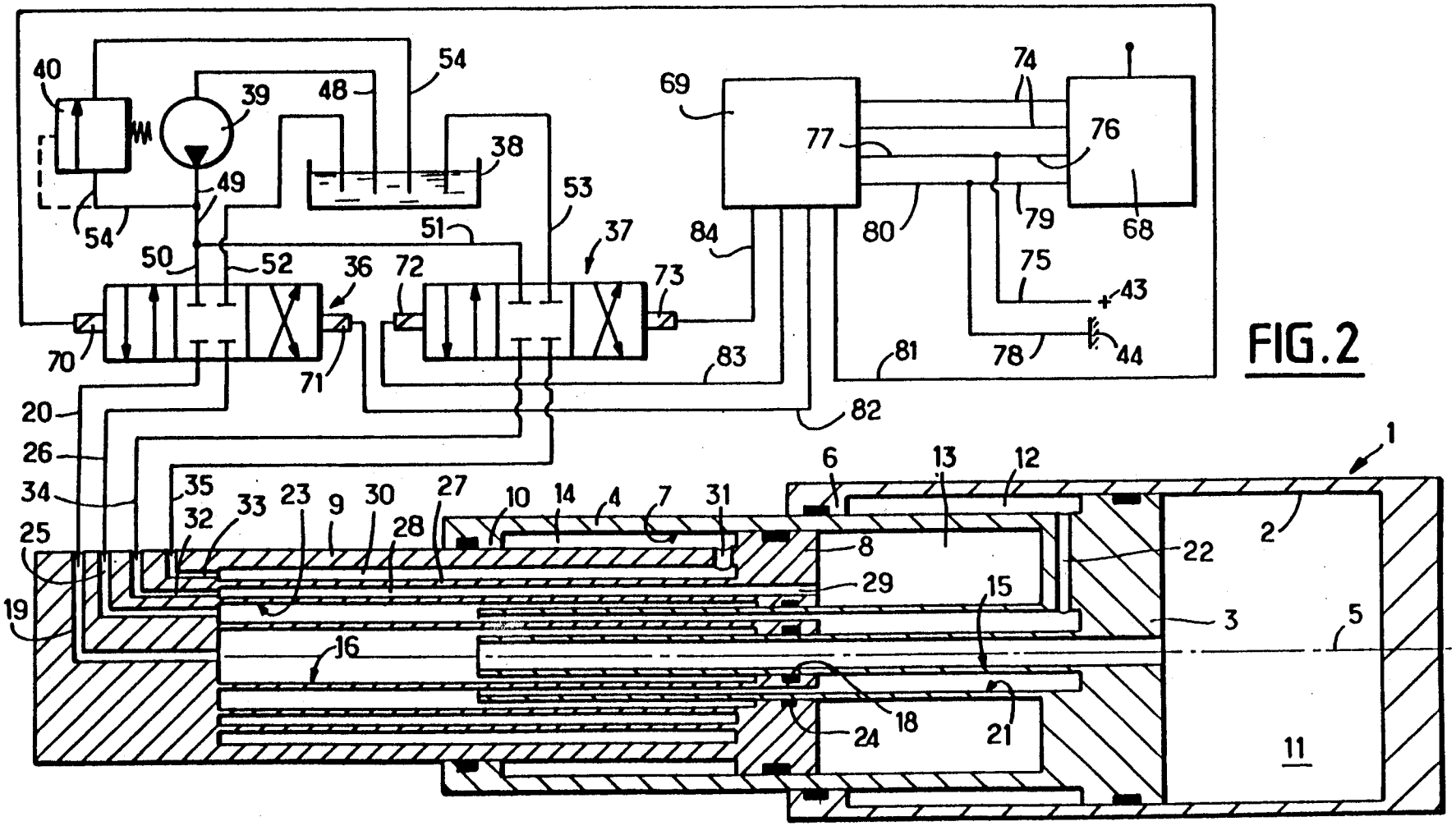
FIG. 2 is the same section of the same jack, associated with the diagram of a second variant embodiment of a pressurized fluid supply circuit, likewise according to the invention.

The circuit for supplying pressurized fluid to jack 1, shown in FIG. 2, comprises:

a first three-way fluid slide valve 36;
a second three-way fluid slide valve 37;
a reservoir 38 of fluid not under pressure;
a pump 39;
a discharge valve 40 for protection against overpressures;
a manipulator 68 with several positions;
a programmed control device 69;
a source of electrical energy supply 43;
an electrical ground 44;
two electro-magnets 70, 71, coupled to the first three-way slide valve 36 and of antagonistic effects;
two electro-magnets 72, 73, coupled to the second three-way slide valve 37, and of antagonistic effects; and
the following links:
the first (20) and second (26) outer conduits, connected to the first three-way slide valve 36;
the third (34) and fourth (35) outer conduits, connected to the second three-way slide valve 37;

the suction conduit 48 of pump 39 connects the latter to reservoir 39;

the delivery conduit 49 of pump 39 is connected to conduits 50 and 51, themselves connected to the first (36) and second (37) three-way slide valves, respectively;

a discharge conduit 52 connects the first three-way slide valve 36 to the reservoir 38;

another discharge conduit 53 connects the second three-way slide valve 37 to reservoir 38;

a conduit 54 connects the delivery conduit 49 to the reservoir 38, the discharge valve 40 being disposed in this conduit 54;

a link 74 connects the manipulator 68 to the control device 69;

an electrical link 75 connects the electrical source 43 to two other electrical links 76, 77, themselves connected to said manipulator 68 and control device 69, respectively;

an electrical link 78 connects the electrical ground 44 to two other electrical links 79, 80, themselves connected to the manipulator 68 and control device 69, respectively;

four electrical links 81, 82, 83, 84 connect the programmed control device 69 to the electro-magnets 70, 71, 72, 73, respectively.

The programmed control device 69 comprises, for example in the form of a calculating machine combined with an interchangeable program, the following seven possibilities of adjustment of the positions of the two three-way slide valves 36, 37, which correspond to as many positions of the manipulator 68:

Mode No. 1: supply of the electro-magnet 70 and nonsupply of electro-magnets 71, 72, 73 and placing of the first three-way slide valve 36 in its first position, and of the second three-way slide valve 37 in its second position;

Mode No. 2: placing of the first slide valve 36 in its third position and of the second slide valve 37 in its second position;

Mode No. 3: placing of the first slide valve 36 in its second position and of the second slide valve 37 in its first position;

Mode No. 4: placing of the first slide valve 36 in its second position and of the second slide valve 37 in its third position;

Mode No. 5: placing of the first slide valve 36 in its first position and of the second slide valve 37 in its first position;

Mode No. 6: placing of the first slide valve 36 in its second position and of the second slide valve in its second position;

Mode No. 7: placing of the first slide valve 36 in its third position and of the second slide valve 37 in its third position.

The interchangeability of the program of the control device 69 naturally makes it possible to retain other combinations of positions of the first (36) and second (37) three-way slide valves.

The three positions of the first three-way slide valve 36 correspond as follows:

the first position, to the communications of conduits 20 and 50 and of conduits 26 and 52;

the second position, to the obturations of conduits 20, 26, 50 and 52; and the third position, to the communications of conduits 20 and 52 and of conduits 26 and 50.

The three positions of the second three-way slide valve 37 correspond as follows:

the first position, to the communications of conduits 34 and 51 and of conduits 35 and 53;

the second position, to the obturations of conduits 34, 35, 51 and 53; and the third position, to the communications of conduits 34 and 53, and of conduits 35 and 51.

When the first piston 3 is disposed in the first cylinder 2 in the position rendering minimum the volume of the first large chamber 11, the displacements of the second piston 8 inside the second cylinder 7 provoke undesirable variations (increases or reductions) in the volumes of the fluid contained in the first large chamber 11 and first small chamber 12. This is, of course, observed both with the circuit of FIG. 1 and with that of FIG. 2. In the absence of particular arrangements, these variations in volumes may provoke phenomena either of cavitation or of overpressure inside said chambers.

Figure 5:
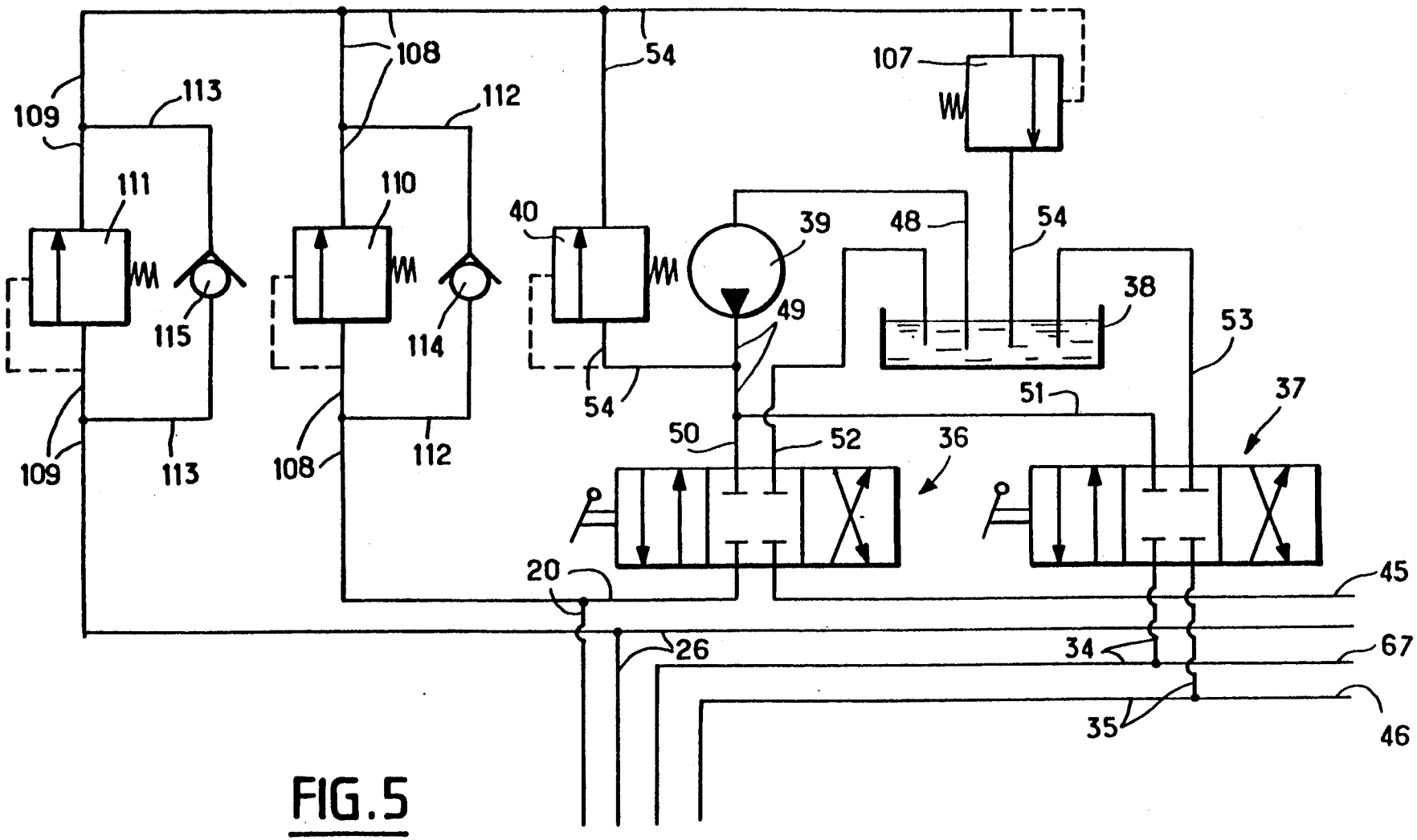
FIG. 5 defines the diagram of a complement of the supply circuit of FIG. 1.

Solely by way of example, the circuit of FIG. 5 defines the complements which may be added to the circuit of FIG. 1 to avoid any risks of cavitation and of overpressure. It is understood that such a complement may be added to the circuit of FIG. 2.

The circuit of FIG. 5 comprises the arrangements of the circuit of FIG. 1, completed as follows:

a discharge valve 107, weakly calibrated (5 to 10 bars) is disposed in conduit 54 between the discharge valve 40 for protection against overpressures (calibration 350 to 400 bars) and the discharge reservoir 38, and constitutes a retention of fluid allowing a boosting;

a conduit 108 connects the first outer conduit 20 to that part of the conduit 54 included between the discharge valve 40 and the discharge valve 107;

a conduit 109 connects the second outer conduit 26 to the conduit 108;

discharge valves 110 and 111 calibrated for protection against overpressures (350 to 400 bars), are disposed in conduits 108 and 109, respectively, conduit 109 being connected to that part of the conduit 108 included between the discharge valve 110 and the conduit 54;

conduits 112 and 113 are connected to conduits 108 and 109, on either side of discharge valves 110 and 111, respectively;

a non-return valve 114 is placed in conduit 112 and allows a fluid to flow in conduit 112, solely from conduit 54 towards the first outer conduit 20;

a non-return valve 115 is placed in conduit 113 and allows flow of the fluid, in conduit 113, solely from conduit 54 towards the second outer conduit 26.

In this way, in the event of a non-controlled increase in the volume of the first large chamber 11, the booster fluid retained at low pressure by the discharge valve 107, conveyed up to the first outer conduit 20 via conduits 54, 108 and 112, and traversing the non-return valve 114, completing the volume of fluid contained in said first large chamber 11, avoids the creation of a cavitation inside said chamber.

A non-controlled reduction in the volume of the first large chamber 11 provokes exhaust of the excess of fluid contained in this chamber via the first outer conduit 20 and conduits 108 and 54, through the discharge valves 110 and 107. The non-return (115) and discharge (111) valves present a similar functioning vis-à-vis the cavitation and overpressure, respectively, inside the first small chamber 12.

Figure 3:
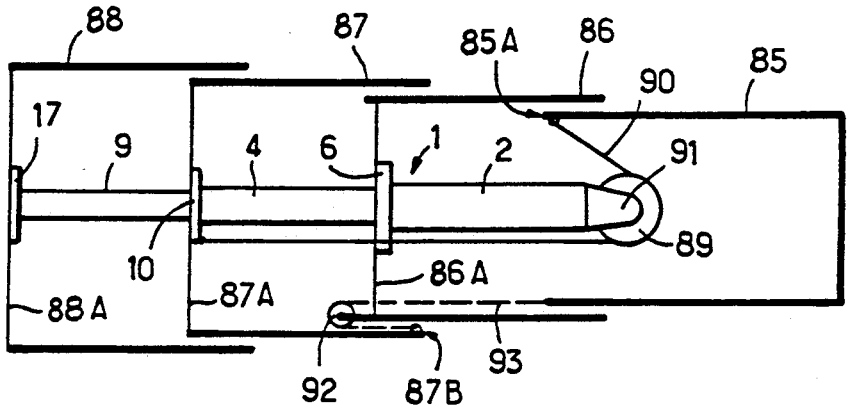
FIG. 3 is a schematic axial section through a telescopic jib according to the invention, comprising four portions.

FIG. 3 shows a telescopic jib with four portions 85, 86, 87, 88. Jack 1 is integrated therein, the bottom of the first cylinder 2 being fixed on the inner end 86A of portion 86, the bottom 10 of thefirst piston rod 4 being fixed on the inner end 87A of portion 87, and the end 17 of the second piston rod 9 being fixed on the bottom 88A of portion 88. Moreover, a toothed wheel 89 for guiding a chain 90 is mounted on the end 91 of the first cylinder 2 opposite bottom 6, the ends of the chain 90 being fixed on the inner end 85A of the portion 85 and on the inner end 87A of portion 87. Similarly, a pulley 92 is mounted on the inner end 86A of the portion 86 and serves as guide for a flexible tie 93, whose ends are fixed to the inner end 85A of portion 85 and outer end 87B of portion 87.

Figure 4:
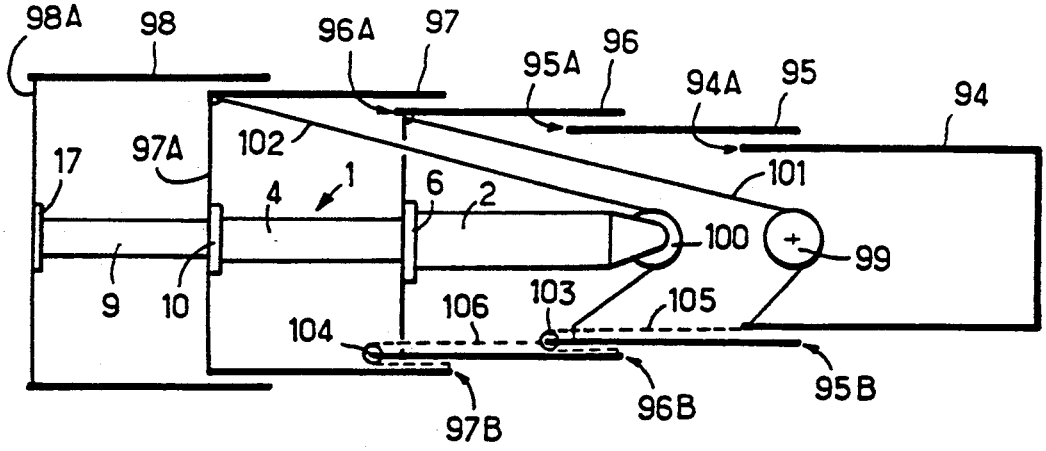
FIG. 4 is a schematic axial section through a telescopic jib according to the invention, comprising five portions.

The telescopic jib of FIG. 4 has five portions 94, 95, 96, 97 and 98; mounted to slide with respect to one another, portion 94 inside portion 95, comprising an inner end 94A, portion 95 inside portion 96, comprising an inner end 95A and an outer end 95B, portion 96 inside portion 97, comprising an inner end 96A and an outer end 96B, and portion 97 inside portion 98, comprising an inner end 97A and an outer end 97B; this portion 98 presenting a bottom 98A. Two toothed wheels 99, 100 are mounted near the inner ends 94A and 95A of portions 94 and 95, respectively. Chains 101, 102 are guided over these toothed wheels 99, 100 and have their ends fixed, chain 101 on the inner end 94A of portion 94 and on the inner end 96A of portion 96, and chain 102 on the inner end 95A of portion 95 and on the inner end 97A of portion 97, respectively. Moreover, two pulleys 103, 104 are mounted near the inner ends 95A, 96A of portions 95, 96, whilst two flexible ties 105, 106, guided over these pulleys, have their ends fixed, tie 105 on the inner end 94A of portion 94 and on the outer end 96B of portion 96, and tie 106 on the inner end 95A of portion 95 and on the outer end 97B of portion 97, respectively.

Jack 1 is integrated in this jib, the bottom 6 of the first cylinder 2 being fixed on the inner end 96A of portion 96, the bottom 10 of the first piston rod 4 being fixed on the inner end 97A of portion 97, and the end 17 of the second piston rod 9 being fixed on the bottom 98A of portion 98. Functioning of the jack of FIG. 1 is set forth hereinafter.

The two-way slide valves 41, 42 being placed in their respective first positions (those shown), the supply of pressurized fluid in the first large chamber 11 and the extension of the first rod 4 of the jack from the first cylinder 2 correspond to the first position of the first slide valve 36. Displacement of retraction of this first rod 4 in the first cylinder 2 is obtained by placing said three-way slide valve 36 in its third position. Similarly, the first position of the second slide valve 37 provokes supply of pressurized fluid in the second large chamber 13 and the extension of the second piston rod 9 with respect to the first piston rod 4, retraction of this second piston rod 9 with respect to this first piston rod 4 being obtained by placing the second three-way slide valve 37 in its third position. The displacements obtained are independent of one another, the relative displacement of the first piston rod 4 with respect to the first cylinder 2 being effected with or without relative displacement of the first (4) and second (9) piston rods.

However, the user may desire to obtain combined displacements. This is possible by placing the two two-way slide valves 41, 42 in their second positions, by acting on switch 59, leaving the second three-way slide valve 37 in its second position, and, depending on whether extension or retraction of jack 1 is desired, placing the first three-way slide valve 36 in its first or in its third position.

In this way, there corresponds to the first position of the first slide valve 36:

- the supply of pressurized fluid, delivered by pump 39, of the first large chamber 11;
- the delivery from the first small chamber 12 of the fluid located therein, towards the first portion 26 of the second outer conduit;
- the supply of the second large chamber 13 by this same fluid coming from the first small chamber 12, via conduits 26, 67 and 34; and
- finally, the exhaust, from the second small chamber 14, of the fluid located therein, via conduits 35, 46, 47, 45 and 52.

The relative displacements of the first piston rod 4 with respect to the first cylinder 2 and of the second piston rod 9 with respect to the first piston rod 4, are thus produced simultaneously. The speeds of these displacements depend on the ratio of the sections of the first small chamber 12 and second large chamber 13; equal speeds of said relative displacements correspond to a ratio of 1.

The jack of FIG. 2 obviously presents the same operational possibilities as the one of FIG. 1, since it is identical thereto.

Modes of operation Nos. 1 and 3, and 2 and 4, correspond to independent displacements, in extension and in retraction, respectively, of the first piston rod 4 with respect to the first cylinder 2 and of the second piston rod 9 with respect to the first piston rod 4.

Modes of operation Nos. 5 and 7 correspond, on the contrary, to combined simultaneous displacements, in extension and in retraction, respectively.

The choices which were offered to the user by the circuit of FIG. 1 are conserved by the circuit of FIG. 2. In addition, the easy replacement of one program by another enables the installation to be very easily adapted to the user's specific needs.

The jib of FIG. 3 may have the following displacements of its various portions, starting from the entirely retracted configuration:

- if only the first piston rod 4 extends with respect to the first cylinder 2, portion 87 remains immobile with respect to portion 88; on the other hand, portion 86 extends with respect to portion 87 and, due to the presence of chain 90, portion 85 extends with respect to portion 86. The speed of extension of portion 85 with respect to portion 86 is equal to that of extension of the portion 86 with respect to portion 87;
- retraction of the portions with respect to one another is effected with displacements inverse with respect to the preceding ones, thanks to jack 1 and to the supple tie 93 and pulley 92;
- when the combined simultaneous displacements are controlled for the elements of jack 1, of the first piston rod 4 with respect to cylinder 2, and of the second piston rod 9 with respect to the first piston rod 4, all the portions extend (or retract) with respect to one another, and at the same relative speed when the relative displacements of the elements of jack 1 are also made with equal relative speeds.

The jib of FIG. 4 similarly allows extension (and retraction) at equal speeds of portion 94 with respect to portion 95, of portion 95 with respect to portion 96, of portion 96 with respect to portion 97, and, if necessary, depending on the user's desire, of portion 97 with respect to portion 98.

The invention is not limited to the embodiments shown, but, on the contrary, covers all the variants which may be made thereto without departing from the scope nor the spirit thereof.

For example, the arrangement of the conduits inside the jack, as shown in FIGS. 1 and 2, may present variant embodiments making it possible, in particular, to reduce or cancel the undesirable variations in the volumes of fluid contained in the first large chamber 11 and first small chamber 12.

What is claimed is:

1. A multiple jack comprising:

a first cylinder;

a first piston, mounted to slide inside the first cylinder, which defines therein a first large chamber, of large useful cross section, and a first small chamber, of small useful cross section;

a first piston rod, which extends from the first piston, traverses a bottom of the first cylinder, to define the first small chamber of the first cylinder, and contains a cylindrical central first recess;

a second cylinder which is constituted by the first recess of the first piston rod, a second piston, mounted to slide inside the second cylinder, which defines therein a second large chamber, of large useful cross section, and a second small chamber, of small useful cross section;

a second piston rod which extends from the second piston and traverses a bottom of the second cylinder to define the second small chamber;

a first inner conduit connecting the first larger chamber to a first outer conduit;

a second inner conduit connecting the first small chamber to a second outer conduit;

a third inner conduit connecting the second larger chamber to a third outer conduit;

a fourth inner conduit connecting the second small chamber to a fourth outer conduit;

the first large and first small chambers and the second large and small chambers are not connected by any link inside the jack;

a first tubular conduit and a second tubular conduit, cylindrical, coaxial and distinct, extending from the first piston, a space separating the first and second tubular conduits, the first tubular conduit being contained in the second tubular conduit and comprising a cylindrical bore constituting a part of the first inner conduit;

a third tubular conduit, extending from the bottom of the second piston rod and penetrating the space separating the first and second tubular conduits;

two O-rings disposed between the second and third tubular conduits, the O-rings defining a chamber which communicates, via an orifice, with the interior of the third tubular conduit such that the cross sectional areas of the first tubular conduit and of the chamber are equal.

2. The jack of claim 1, wherein a second recess is made in the second piston rod and in the second piston, whilst a first channel, which traverses the first piston and the first piston rod, being integral therewith, is mounted to slide inside this second recess and traverses the second piston with seal, and a second channel, made in the second piston rod, connects the second recess to the first outer conduit, the assembly of the second recess and the first and second channels constituting said first inner conduit.

3. The jack of claim 2, wherein the first piston presents an axis of symmetry, the first channel being coaxial to said axis of symmetry.

4. The jack of claim 1, wherein a third recess is made in the second piston rod, whilst a third channel which traverses the first piston rod up to the first piston, is mounted to slide inside the third recess and extends from the first piston, traverses with seal the second piston, communicates with a connecting channel which opens out in the first small chamber, and a fourth channel, made in the second piston rod, connects the third recess to the second outer conduit, the assembly of the third recess, the connecting channel, the third channel, and the fourth channel constituting said second inner conduit.

5. The jack of claim 4, wherein the connecting channel is made in the first piston.

6. The jack of claim 4, wherein the first piston presents an axis of symmetry, the third channel having an annular section and being coaxial to said axis of symmetry.

7. The jack of claim 1, wherein the third inner conduit comprises a fifth channel, formed in the second piston rod and second piston, and a seventh channel, formed in the second piston, such that the third inner conduit connects the second large chamber to the third outer conduit.

8. The jack of claim 7, wherein the first piston presents an axis of symmetry, the fifth channel having a portion which extends parallel to said axis of symmetry, in eccentric manner with respect to said axis of symmetry.

9. The jack of claim 1, wherein the fourth inner conduit comprises a connecting conduit, a sixth channel, and an eighth channel which are made solely in the second piston rod and which connect the second small chamber to the fourth outer conduit.

10. The jack of claim 9, wherein the first piston presents an axis of symmetry, the sixth channel having a portion which extends parallel to said axis of symmetry, in eccentric manner with respect to said axis of symmetry.

11. A circuit for supplying pressurized fluid to the jack of claim 1, wherein it comprises:

in addition to such a jack:

a pump provided with its delivery conduit;

a discharge reservoir;

a first fluid slide valve to which are connected said delivery conduit, a discharge conduit connected to the reservoir, and the first and second outer conduits, and which comprises at least first and second positions, the first position corresponding to the communications of the delivery conduit and the first outer conduit and of the second outer conduit and of the discharge conduit, and the second position corresponds to the obturation of at least one of the first and second outer conduits; and a second fluid slide valve to which are connected said delivery conduit, a discharge conduit connected to the reservoir, and the third and fourth outer conduits, and which comprises at least first and second positions, the first position corresponding to the communications of the delivery conduit and of the third outer conduit and of the fourth outer conduit and the discharge conduit, and the second position corresponds to the obturation of at least one of the third and fourth outer conduits.

12. The circuit of claim 11, further comprising a two-position slide valve assembly interposed on the second outer conduit and the fifth outer conduit such that:

the two-position slide valve assembly separates the second outer conduit into a first portion connected to the jack and a second portion connected to the first fluid slide valve;

the two-position slide valve assembly separates the fifth outer conduit into a first portion connected to the fourth outer conduit and a second portion connected to the second portion of the second outer conduit;

a sixth outer conduit connects the third outer conduit to the two-position slide valve assembly;

the two positions of the third slide valve assembly the first position of the two-position slide valve assembly enables the communication of the first and second portions of the second outer conduit, the obturation of at least one of the first and second portions of the fifth outer conduit, and the obturation of the sixth outer conduit;

the second position of the twoposition slide valve assembly enables the obturation of the second portion of the second outer conduit, the communication of the first portion of the second outer conduit with the sixth outer conduit, and the communication of the first portion of the fifth outer conduit with the second portion of the fifth outer conduit.

13. The circuit of claim 11, wherein the first slide valve comprises a third position corresponding to the communications of the delivery conduit and of the second outer conduit and of the first outer conduit and of the discharge conduit, the second slide valve likewise comprising a third position corresponding to the communication of the delivery conduit and of the fourth outer conduit and of the third outer conduit and of the discharge conduit, whilst each of said first and second slide valves comprises a device for selecting its position, said positionselection devices being connected to the same device for combining the selections, for example of electromagnetic or electronic type, capable of making the following associations of positions:

one of the first and third positions of the first slide valve with the second position of the second slide valve;

one of the first and third positions of the second slide valve with the second position of the first slide valve;

the respective positions of the same row (first, or second, or third positions) of the first and second slide valves.

14. A telescopic jib having at least first, second and third portions mounted for relative slide one with respect to the following and applying the jack of claim 1, wherein:

f) the bottom of the first cylinder, which defines the first small chamber, is fixed on one end of the first portion of the telescopic jib;

g) the end of the first piston rod, which is opposite the first piston, is fixed on one end of the second portion of the telescopic jib; and h) the end of the second piston rod, which is opposite the second piston, is fixed on one end of the third portion of the telescopic jib.

15. A telescopic jib having at least first, second and third portions mounted for relative slide one with respect to the following and applying the circuit of claim 11, wherein:

f) the bottom of the first cylinder, which defines the first small chamber, is fixed on one end of the first portion of the telescopic jib;

g) the end of the first piston rod, which is opposite the first piston, is fixed on one end of the second portion of the telescopic jib; and h) the end of the second piston rod, which is opposite the second piston, is fixed on one end of the third portion of the telescopic jib.

16. A multiple jack incorporating at least three elements mounted to slide with respect to one another, and a circuit for supplying pressurized fluid to such jack, comprising:

a first cylinder;

a first piston, mounted to slide inside the first cylinder, which defines therein a first large chamber, of large useful cross section, and a first small chamber, of small useful cross section;

a first piston rod, which extends from the first piston, traverses a bottom of the first cylinder to define the first small chamber of the first cylinder, and contains a cylindrical central first recess;

a second cylinder, which is constituted by the first recess of the first piston rod, a second piston, mounted to slide inside the second cylinder, which defines therein a second large chamber, of large useful cross section, and a second small chamber, of small useful cross section;

a second piston rod which extends from the second piston and traverses a bottom of the second cylinder to define the second small chamber;

a first inner conduit connecting the first large chamber to a first outer conduit;

a second inner conduit connecting the first small chamber to a second outer conduit;

a third inner conduit connecting the second large chamber to a third outer conduit;

a fourth inner conduit connecting the second small chamber to a fourth outer conduit;

a pump with delivery conduit;

a discharge reservoir;

a first fluid slide valve to which are connected the delivery conduit, a discharge conduit connected to the discharge reservoir, and the first and second outer conduits, with at least first and second positions, the first position corresponding to the communications of the delivery conduit with the first outer conduit and the second outer conduit with the discharge conduit, the second position corresponding to the obturation of at least one of the first and second outer conduits;

a second fluid slide valve to which are connected the delivery conduit, a discharge conduit connected to the discharge reservoir, and the third and fourth outer conduits, with at least first and second positions, the first position corresponding to the communications of the delivery conduit with the third outer conduit and the fourth outer conduit with the discharge conduit, the second position corresponding to the obturation of at least one of the third and fourth outer conduits;

a two-position slide valve assembly interposed on the second outer conduit and the fifth outer conduit, the twoposition slide valve assembly separating the second outer conduit into a first portion connected to the jack and a second portion connected to the first fluid slide valve, the two-position slide valve assembly separating the fifth outer conduit into a first portion connected to the fourth outer conduit and a second portion connected to the second portion of the second outer conduit, a sixth outer conduit connecting the third outer conduit to the two-position slide valve assembly, the first position of the twoposition position slide valve assembly enabling the communication of the first and second portions of the second outer conduit, the obturation of at least one of the first and second portions of the fifth outer conduit, and the obturation of the sixth outer conduit. the second position of the two-position slide valve assembly enabling the obturation of the second portion of the second outer conduit, the communication of the first portion of the second outer conduit with the sixth outer conduit, and the communication of the first portion of the fifth outer conduit with the second portion of the fifth outer conduit.

* * * * *

UNITED STATES PATENT AND TRADEMARK OFFICE

CERTIFICATE OF CORRECTION

PATENT NO. : 5,111,733
DATED : May 12, 1992
INVENTOR(S) : Robert Baraniak

It is certified that error appears in the above-identified patent and that said Letters Patent is hereby corrected as shown below:

col. 11, line 34, delete "larger" and insert --large--;

col. 11, line 38, delete "larger" and insert --large--.

Signed and Sealed this

Twelfth Day of October, 1993

*Attest:*

*Attesting Officer*

Bruce Lehman

BRUCE LEHMAN

*Commissioner of Patents and Trademarks*